US009060576B2

(12) United States Patent
Siegenthaler

(10) Patent No.: US 9,060,576 B2
(45) Date of Patent: Jun. 23, 2015

(54) UMBRELLA SLIDE

(75) Inventor: Robert Siegenthaler, Bulach (CH)

(73) Assignee: Glatz AG, Frauenfeld (CH)

( * ) Notice: Subject to any disclaimer, the term of this patent is extended or adjusted under 35 U.S.C. 154(b) by 0 days.

(21) Appl. No.: 14/123,846

(22) PCT Filed: May 3, 2012

(86) PCT No.: PCT/EP2012/058089

§ 371 (c)(1),
(2), (4) Date: Dec. 4, 2013

(87) PCT Pub. No.: WO2012/168008

PCT Pub. Date: Dec. 13, 2012

(65) Prior Publication Data

US 2014/0096803 A1 Apr. 10, 2014

(30) Foreign Application Priority Data

Jun. 6, 2011 (EP) ..... 11168812

(51) Int. Cl.
*A45B 25/06* (2006.01)
*A45B 25/08* (2006.01)

(52) U.S. Cl.
CPC ..... *A45B 25/08* (2013.01); *A45B 25/06* (2013.01)

(58) Field of Classification Search
CPC ..... A45B 25/06; A45B 25/08
USPC ..... 135/28, 37, 38, 40
See application file for complete search history.

(56) References Cited

U.S. PATENT DOCUMENTS

| | | | | | |
|---|---|---|---|---|---|
| 2,725,888 | A | * | 12/1955 | Haupt | 135/38 |
| 3,156,249 | A | * | 11/1964 | Biderman | 135/15.1 |
| 5,036,872 | A | * | 8/1991 | Huang | 135/22 |
| 5,398,709 | A | * | 3/1995 | Lee | 135/28 |
| 5,740,824 | A | * | 4/1998 | Tang | 135/28 |
| 6,390,107 | B1 | * | 5/2002 | Lin et al. | 135/25.4 |
| 7,210,491 | B2 | * | 5/2007 | Su | 135/28 |
| 7,255,119 | B2 | * | 8/2007 | Lin et al. | 135/38 |
| 7,575,009 | B2 | * | 8/2009 | Chang | 135/28 |
| 8,356,612 | B2 | * | 1/2013 | Liu | 135/28 |
| 8,424,547 | B1 | * | 4/2013 | Ma et al. | 135/40 |
| 2004/0011391 | A1 | | 1/2004 | Lin et al. | |
| 2004/0025913 | A1 | * | 2/2004 | Kuo | 135/22 |

FOREIGN PATENT DOCUMENTS

| | | |
|---|---|---|
| EP | 0 934 708 A1 | 8/1999 |
| FR | 1 176 898 A | 4/1959 |

* cited by examiner

*Primary Examiner* — Noah Chandler Hawk
(74) *Attorney, Agent, or Firm* — George Pappas

(57) ABSTRACT

In order to improve a free-standing parasol, particularly a large parasol, in which canopy rods of a canopy are supported through supporting struts on an accommodating collar (8) of a slider (2), which, with the canopy open, can be latched to a parasol pole (4) through a releasable pawl (26) and a catch (30), wherein the pawl (26) is arranged on a tilting lever (12), it is proposed that the tilting lever (12) be surrounded by a housing (20) that comprises bearings (22) for the hinge pin (40). The tilting lever (12) itself has an operating button (13). The housing (20) comprises an aperture (21), through which the the operating button is made accessible. The hinge pin (40) of the tilting lever (12) is oriented transversely to the longitudinal axis (42) of the parasol pole (4) and the hinge pin (40) is closer to the longitudinal axis (42) of the parasol pole (4) than the pawl (26).

22 Claims, 5 Drawing Sheets

UMBRELLA SLIDE

This application claims priority from PCT application No. PCT/EP2012/058089 filed May 3, 2012 which claims priory from European application No. EP 11168812.3 filed on Jun. 6, 2011, the disclosures of which are incorporated herein by reference.

TECHNICAL FIELD

The invention relates to a parasol slider with a locking device for a parasol.

BACKGROUND ART

In parasols, particularly in large parasols, of the above mentioned type, sliders are used for opening and closing a canopy, wherein a locking device locks the canopy in its open and tensioned state.

From EP 0 934 708 A1 there is known a parasol with such a locking device having a slider and a hand lever. The above parasol has been found to need further improvement in that, on the one hand, the construction and also the handling could be simplified and, further, some protection against dirt etc. would be desirable. Furthermore, the exposed mechanical system bears some risk of catching the hand or parts thereof.

In FR 1 176 898 A there is disclosed a parasol in which canopy rods of a canopy are supported through supporting struts on an accommodating collar of a slider, which, with the canopy open, can be latched to a parasol pole through a releasable pawl and a catch, wherein the pawl is arranged on a tilting lever that extends along a sliding direction of the slider and is articulately connected thereto, and wherein the hinge pin of the tilting lever is oriented transversely to the longitudinal axis of the parasol pole. In FR 1 176 898 A the hinge pin of the tilting lever is arranged far outside of the pole and, thus, the pawl that engages into the pole for locking purposes is located closer to the longitudinal axis of the parasol pole than the hinge pin, and by means of a corresponding encasement of the pawl this also applies in the opened state thereof. In the parasol known from FR 1 176 898 A, the tilting lever (8) is surrounded by parts of the slider that have an enlarged radius at this position, whereby the slider does not get into close contact with the pole. The tilting lever has an operating button, and the surrounding parts of the slider have an aperture through which the operating button is made accessible.

In US 2004/0 011 391 A1 there is described a parasol wherein canopy rods of a canopy are supported through supporting struts on an accommodating collar of a slider, which, with the canopy open, can be latched to a pole top mounting through a releasable pawl and a catch, wherein the pawl is arranged on a tilting lever that extends along a sliding direction of the slider and is articulately connected thereto, and wherein the hinge pin of the tilting lever is oriented transversely to the longitudinal axis of the parasol pole. Also in US 2004/0 011 391 A1 the hinge pin of the tilting lever is arranged far outside of the pole and, thus, the pawl that engages into the pole for locking is also closer to the longitudinal axis of the parasol pole than the hinge pin, and due to the geometry proposed therein this also applies in the opened state thereof. Because in US 2004/0 011 391 A1 the pawl of the tilting lever shall be configured to latch into a catch of the pole top—and not into the pole itself—the pawl of the tilting lever is exposed and unprotected.

SUMMARY OF THE INVENTION

The object of the invention is to improve a parasol of the mentioned type based on the above considerations.

If the hinge pin of the tilting lever does not pass perpendicularly through the longitudinal axis of the parasol pole, which would be a special case, the hinge pin of the tilting lever—according to the present invention—is closer to the longitudinal axis than the pawl, in the sense that the hinge pin of the tilting lever has a smaller distance from the longitudinal axis of the parasol pole then the pawl, and this applies in every operating position of the pawl.

At the outset, the measures of the invention have the result that in the parasol according to the present invention the tilting lever is surrounded by a housing that comprises bearings for the hinge pin. With such a housing an improved protection is achieved as compared to the mentioned prior art. The tilting lever has an operating button, and the housing has an aperture through which the operating button is accessible. This results in an easier operation.

Advantageously, the slider comprises a sliding sleeve which is formed as an integrated component with the housing.

The hinge pin of the tilting lever can be formed as an integrated component with the housing.

It is advantageous if the tilting lever comprises swivel arms and the hinge pin is formed as hinge bolts that are lockable to the housing. Therein the hinge bolts are arranged at the outside of the swivel arms. In this manner, distance bulges can be arranged at the side opposed to the hinge bolts which avoid unlocking in an assembled state. According to one aspect of the invention the accommodating collar comprises a removable top portion. For the tilting lever it is advantageous to have a flexible tongue that is formed as an integrated component with the tilting lever. The catch may be formed in different ways, namely as sleeve with rib, as bracket with transversal rib or as aperture in the parasol pole, each of these embodiments having specific structural and constructive advantages, and it may also be configured with multiple stages for fine adjustment.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which parasols according to the present invention are illustrated by way of example. In the drawings there is shown, in.

DESCRIPTION OF THE PREFERRED EMBODIMENTS

Figure 1:
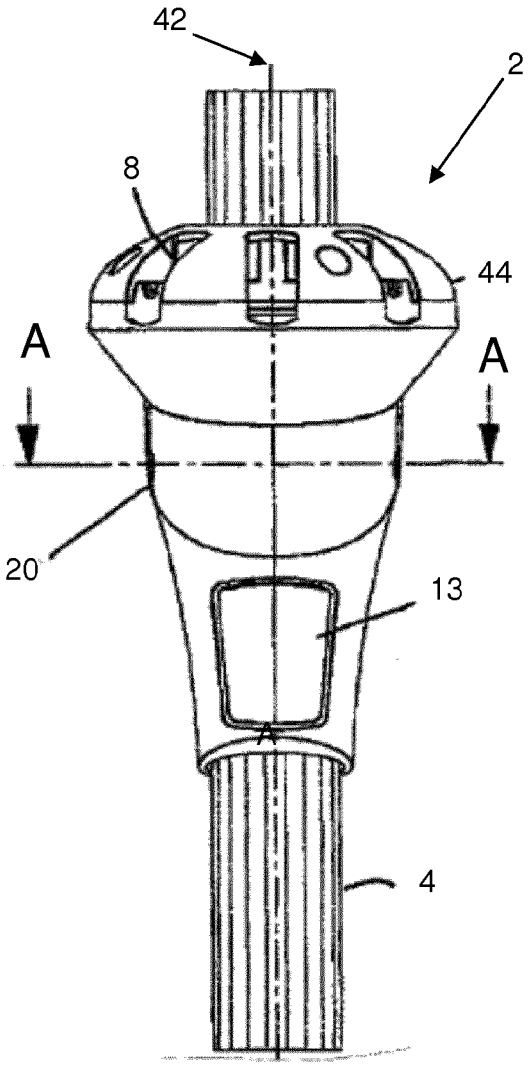
FIG. 1 a front view of a pole section of the parasol with a slider according to a preferred exemplary embodiment of the present invention, from the front, with a front view onto the operating button.

For the pole with slider of a parasol shown in FIG. 1, canopy rods of the canopy (not shown here) are supported through supporting struts on an accommodating collar 8 of a slider 2, which, with the canopy open, can be latched to a parasol pole 4 through a releasable pawl 26 and a catch 30. The pawl 26 is arranged on a tilting lever 12 that extends along a sliding direction of the slider 2 and is articulately connected thereto. The hinge pin 40 of the tilting lever 12 is oriented transversely to the longitudinal axis 42 of the parasol pole 4. The hinge pin 40 is closer to the longitudinal axis 42 of the parasol pole 4 than the pawl 26, in order to achieve an advantageous pawl effect. The tilting lever 12 is surrounded by a housing 20 that comprises bearings 22 for the hinge pin 40. The tilting lever 12 has an operating button 13. In order to ensure a particular protection, the housing 20 comprises an aperture through which the operating button is made accessible. In the exemplary embodiment presented here, the slider 2 of the present invention comprises a sliding sleeve 6. In this exemplary embodiment, the sliding sleeve 6 is formed as a component that is integrated with the housing 20.

In the exemplary embodiment according to FIGS. 1 to 6, the tilting lever 12 comprises swivel arms 14. The hinge pin 40 is formed as hinge bolts that are lockable to the housing 20. The hinge bolts 40*a* are arranged at the outside of the swivel arms 14. Distance bulges 40*b* are arranged at the opposite side of the hinge bolts 40*a*.

In this exemplary embodiment, the accommodating collar 8 comprises a removable top portion 44.

Figure 2:
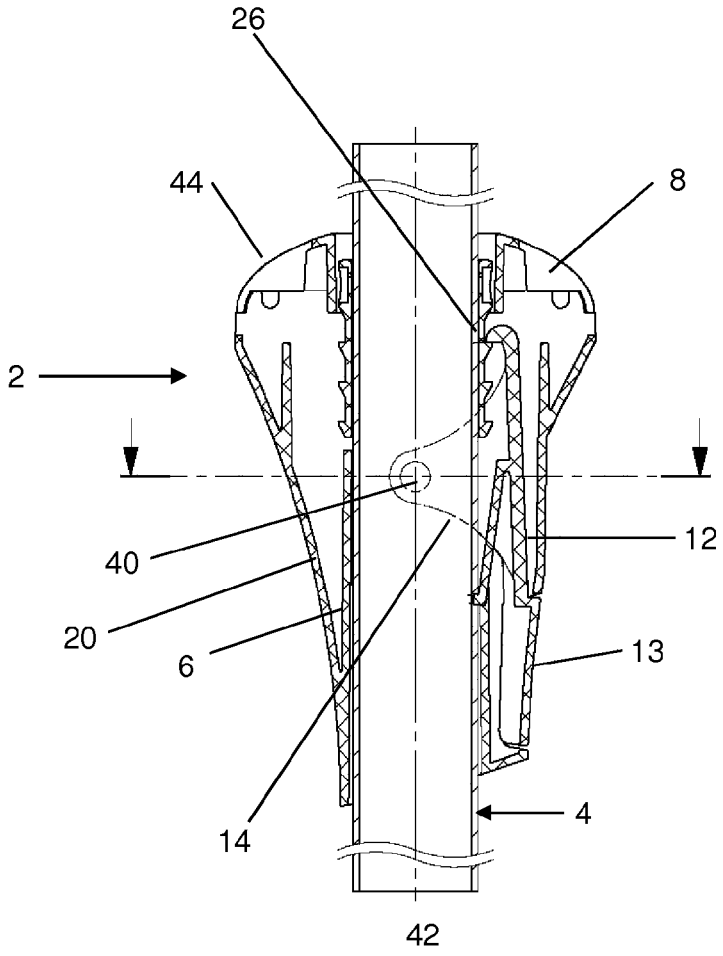
FIG. 2 a cutaway drawing to visualize the internal elements according to FIG. 1, from the side, i.e. in a lateral view onto the tilting lever.
Figure 3:
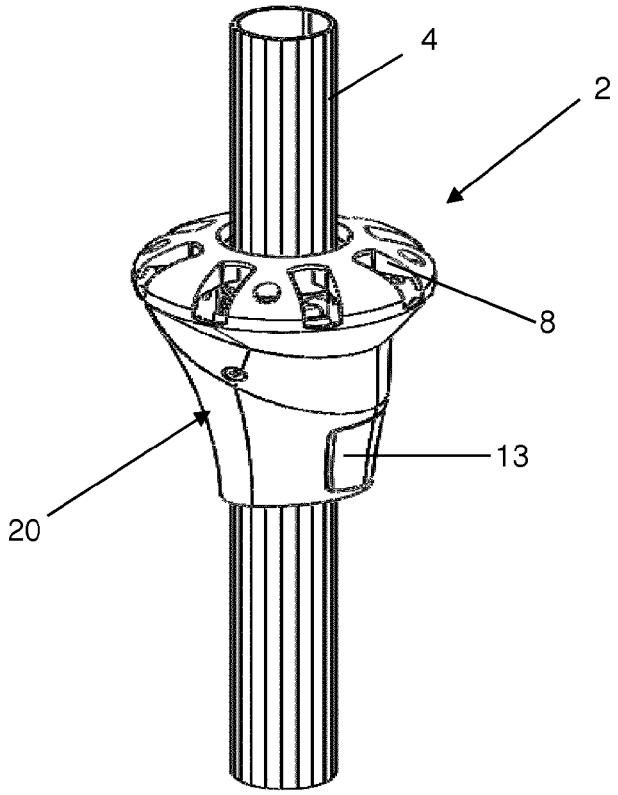
FIG. 3 a perspective view according to FIG. 1, in a skewed top view.
Figure 4:
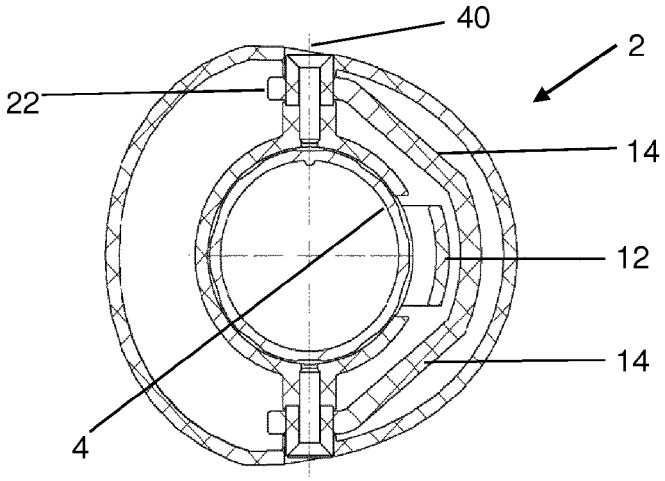
FIG. 4 a cutaway drawing through the slider and the pole according to FIG. 1 along Line A-A.
Figure 5:
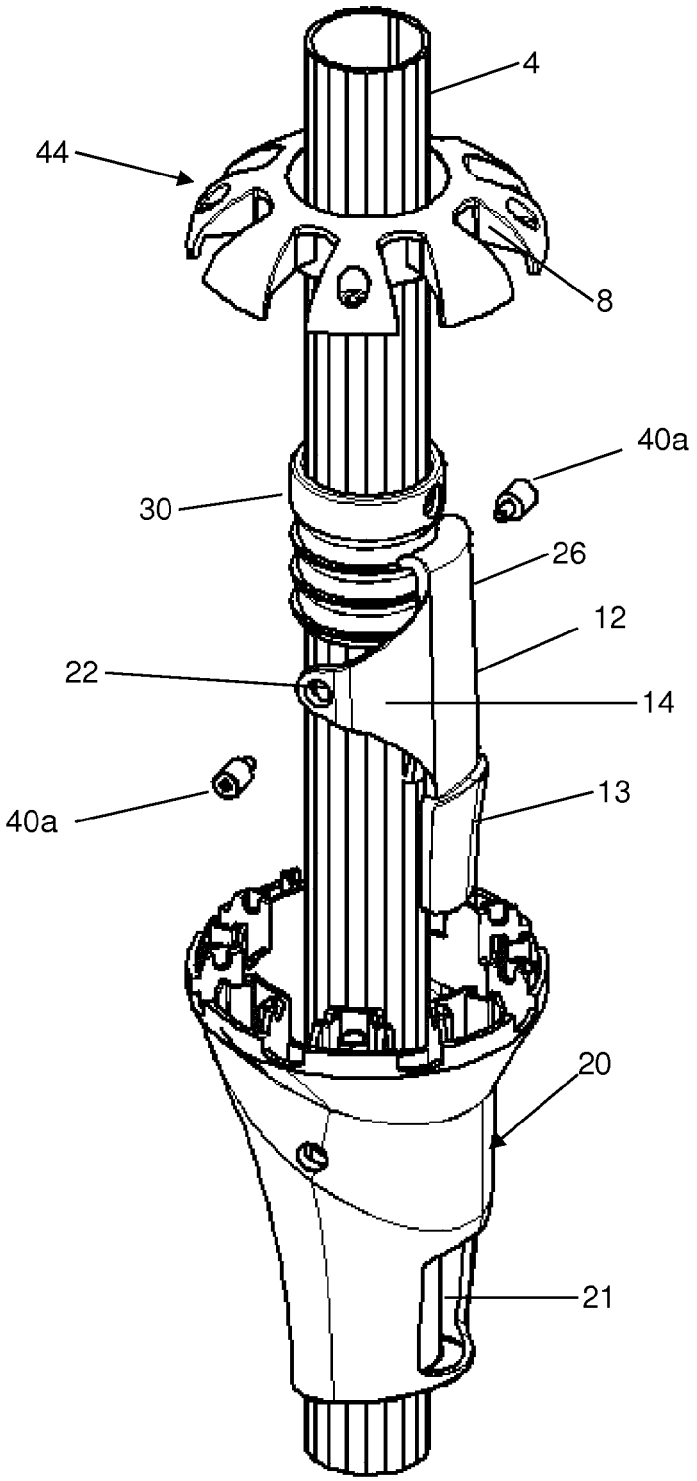
FIG. 5 an exploded view with the components according to FIG. 1.
Figure 6:
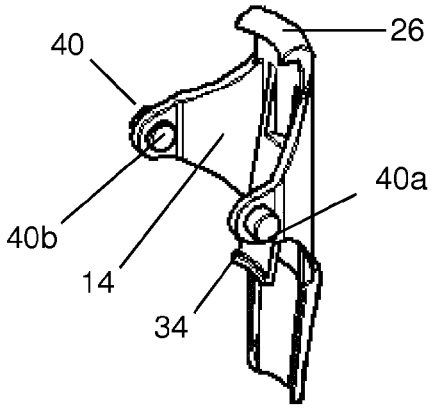
FIG. 6 a view of the tilting lever according to a preferred exemplary embodiment with the swivel arms.

As seen in FIG. 2, there is provided a flexible tongue 34 for the tilting lever 12. In this exemplary embodiment, the flexible tongue 34 is formed as a component that is integrated with the tilting lever 12.

Figure 7:
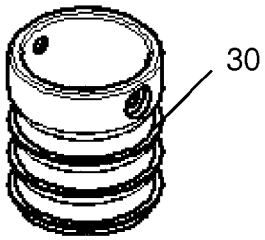
FIG. 7 a view of the catch configured as a multistage sleeve with ribs, according to a specific exemplary embodiment according to FIGS. 1 to 6.
Figure 8:
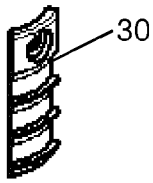
FIG. 8 a view of the catch configured as bracket with transversal ribs, according to an alternative exemplary embodiment.
Figure 9:
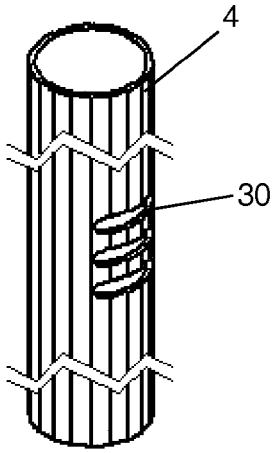
FIG. 9 a view of the catch configured as aperture in the parasol pole, according to a further alternative exemplary embodiment.

In a first exemplary embodiment of the catch according to FIG. 7, the catch is formed as a multistage sleeve with ribs. Alternatively, the catch may also be formed as a bracket with transversal ribs according to FIG. 8 or as an aperture in the parasol pole 4 according to FIG. 9.

LIST OF REFERENCE NUMERALS

2 slider
4 parasol pole
6 sliding sleeve
8 accommodating collar
12 tilting lever
13 operating button
14 swivel arms
20 housing
21 aperture
22 bearing
26 pawl
30 catch
34 flexible tongue
40 hinge pin
40*a* hinge bolt
40*b* distance bulge
42 longitudinal axis of the parasol pole
44 removable top portion of the housing

The invention claimed is:

1. A parasol, particularly a large parasol, in which canopy rods of a canopy are supported through supporting struts on an accommodating collar of a slider, which, with the canopy open, can be latched to a parasol pole through a releasable pawl and a catch, wherein the pawl is arranged on a tilting lever that extends along a sliding direction of the slider and is articulately connected thereto, and wherein a hinge pin of the tilting lever is oriented transversely to the longitudinal axis of the parasol pole characterized in that:

the hinge pin of the tilting lever passes perpendicularly through the longitudinal axis of the parasol pole, the tilting lever is enclosed by a housing that comprises bearings for the hinge pin, and the tilting lever has an operating button, wherein the housing comprises an aperture through which operating button is made accessible.

2. The parasol according to claim 1, characterized in that the slider comprises a sliding sleeve, which sliding sleeve is formed as an integrated component with the housing.

3. The parasol according to claim 2, characterized in that the hinge pin of the tilting lever is formed as an integrated component with the housing.

4. The parasol according to claim 2, characterized in that the tilting lever comprises swivel arms and the hinge pin is formed as hinge bolts that are lockable to the housing, the hinge bolts being arranged at the outside of the swivel arms.

5. The parasol according to claim 2, characterized in that the accommodating collar comprises a removable top portion.

6. The parasol according to claim 2, characterized by having a flexible tongue for the tilting lever, wherein the flexible tongue is formed as an integrated component with the tilting lever.

7. The parasol according to claim 1, characterized in that the hinge pin of the tilting lever is formed as an integrated component with the housing.

8. The parasol according to claim 7, characterized in that the accommodating collar comprises a removable top portion.

9. The parasol according to claim 7, characterized by having a flexible tongue for the tilting lever, wherein the flexible tongue is formed as an integrated component with the tilting lever.

10. The parasol according to claim 1, characterized in that the tilting lever comprises swivel arms and the hinge pin is formed as hinge bolts that are lockable to the housing, the hinge bolts being arranged at the outside of the swivel arms.

11. The parasol according to claim 10, characterized in that the accommodating collar comprises a removable top portion.

12. The parasol according to claim 10, characterized by having a flexible tongue for the tilting lever, wherein the flexible tongue is formed as an integrated component with the tilting lever.

13. The parasol according to claim 10, characterized in that distance bulges are arranged inside the swivel arms.

14. The parasol according to claim 13, characterized in that the accommodating collar comprises a removable top portion.

15. The parasol according to claim 13, characterized by having a flexible tongue for the tilting lever, wherein the flexible tongue is formed as an integrated component with the tilting lever.

16. The parasol according to claim 1, characterized in that the accommodating collar comprises a removable top portion.

17. The parasol according to claim 16, characterized by having a flexible tongue for the tilting lever, wherein the flexible tongue is formed as an integrated component with the tilting lever.

18. The parasol according to claim 1, characterized by having a flexible tongue for the tilting lever, wherein the flexible tongue is formed as an integrated component with the tilting lever.

19. The parasol according to claim 1, characterized in that the catch is formed as a sleeve with rib.

20. The parasol according to claim 19, characterized in that the catch is formed with several stages.

21. The parasol according to claim 1, characterized in that the catch is formed as a bracket with ribs.

22. The parasol according to claim 1, characterized in that the catch is formed as an aperture in the parasol pole.

* * * * *